US011692673B1

(12) United States Patent
Corl

(10) Patent No.: US 11,692,673 B1
(45) Date of Patent: Jul. 4, 2023

(54) TENSIONED INTRA-DEWAR SPIDER ASSEMBLY

(71) Applicant: Wavefront Research, Inc., Northampton, PA (US)

(72) Inventor: Jonas D. Corl, Bethlehem, PA (US)

(73) Assignee: Wavefront Research Inc., Northampton, PA (US)

( * ) Notice: Subject to any disclaimer, the term of this patent is extended or adjusted under 35 U.S.C. 154(b) by 314 days.

(21) Appl. No.: 17/023,255

(22) Filed: Sep. 16, 2020

Related U.S. Application Data

(60) Provisional application No. 62/901,018, filed on Sep. 16, 2019.

(51) Int. Cl.
*F17C 13/08* (2006.01)

(52) U.S. Cl.
CPC ..... *F17C 13/086* (2013.01); *F17C 2203/014* (2013.01); *F17C 2203/0629* (2013.01); *F17C 2270/0509* (2013.01)

(58) Field of Classification Search
CPC ..... F17C 13/086; F17C 2203/0629; F17C 2203/014; F17C 2270/0509
See application file for complete search history.

(56) References Cited

U.S. PATENT DOCUMENTS

| | | | | |
|---|---|---|---|---|
| 2,467,428 | A * | 4/1949 | Hansen | F17C 13/086 220/592.27 |
| 4,674,289 | A * | 6/1987 | Andonian | F17C 9/00 62/47.1 |
| 7,344,045 | B2 * | 3/2008 | Harper | F17C 1/00 220/62.18 |
| 2007/0084221 | A1 | 4/2007 | Ruocco-Angari | |

* cited by examiner

*Primary Examiner* — Stephen J Castellano
(74) *Attorney, Agent, or Firm* — Culhane Meadows PLLC; Orlando Lopez

(57) ABSTRACT

A tensioned intra-Dewar spider assembly that can support a large system inside the Dewar in a way that adds as little thermal load as possible, doesn't overly stress the coldfinger, maintains alignment, and isolates the components from the vibrations of the cryocooler is disclosed.

16 Claims, 3 Drawing Sheets

Cross-Sectional View of an Embodiment of the Disclosed Invention Supporting Electronic, Optical, and Mechanical Components in a Dewar

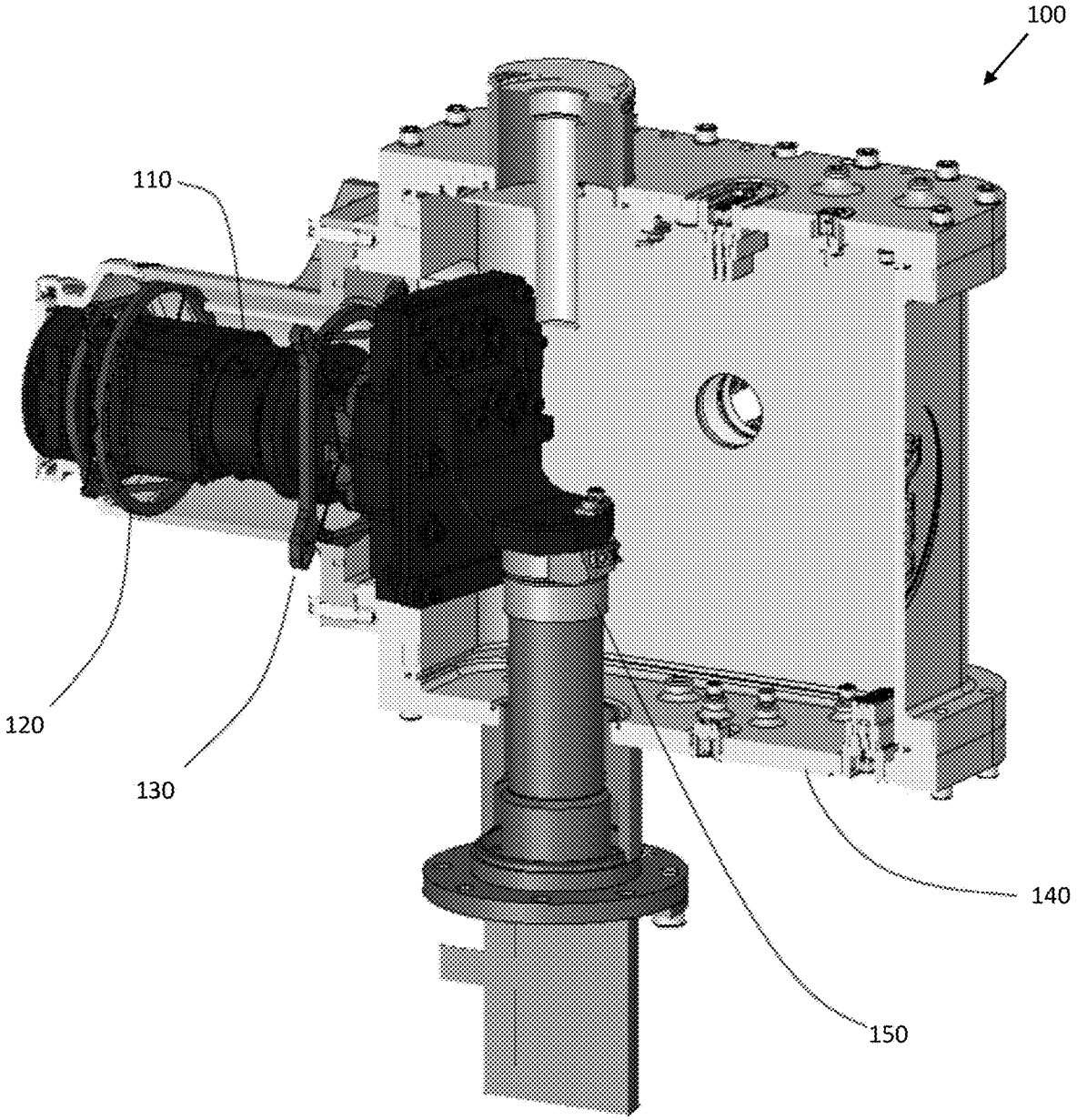
Figure 1 – Cross-Sectional View of an Embodiment of the Disclosed Invention Supporting Electronic, Optical, and Mechanical Components in a Dewar

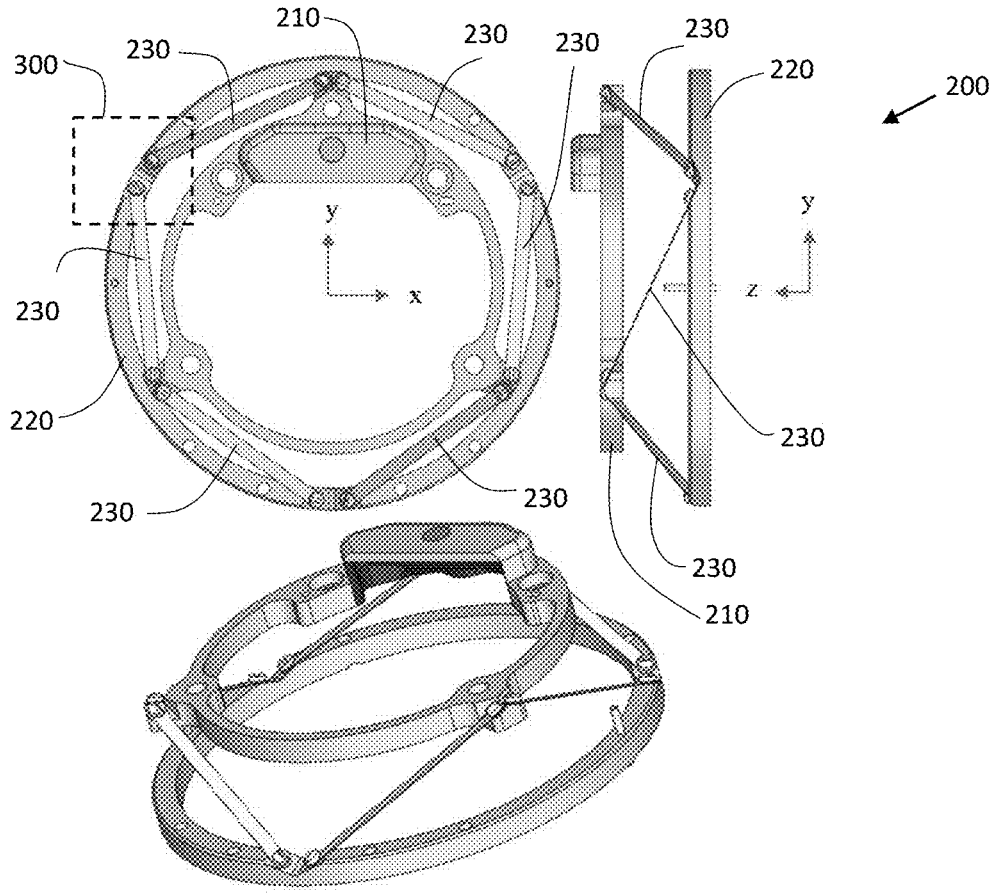
Figure 2 -- Three views of an Embodiment of the Disclosed Invention

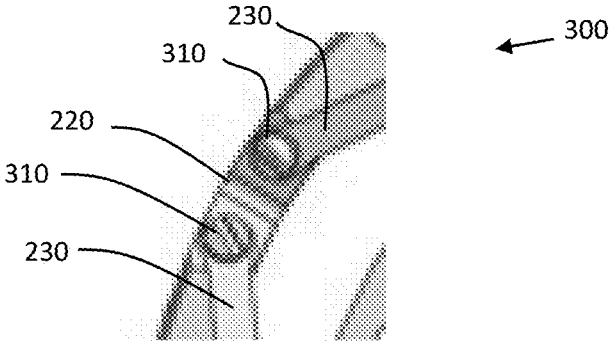
Figure 3 – Detail of tensioned member attachment point

TENSIONED INTRA-DEWAR SPIDER ASSEMBLY

CROSS-REFERENCE TO RELATED APPLICATIONS

This application claims priority of U.S. Provisional Application Ser. 62/901,018, filed Sep. 16, 2019, entitled: TENSIONED INTRA-DEWAR SPIDER ASSEMBLY, which is incorporated herein by reference in its entirety for all purposes whatsoever.

STATEMENT OF GOVERNMENT INTEREST

This invention was made with U.S. Government support from the U.S. Army under contract W909MY-12-D-0008/0012 subcontract PO 22713; and under contract W909MY-17-C-0018. The U.S. Government has certain rights in the invention.

BACKGROUND

These teachings relate generally to thermally isolating cryogenic support structures and, more particularly, to a novel spider design for use in substantially thermally isolating and structurally supporting the cryogenically cooled components in a Dewar in an imaging system.

In traditional systems employing a cryogenic Dewar and cryocooler to cool a detector, the detector assembly is mounted directly to the coldfinger of the cryocooler and little else beyond a cold shield or filter is required to be supported within the Dewar and to be cooled with the cryocooler. In those systems, the coldfinger can provide sufficient structural support for all cooled components, or minor insulating standoffs can supplement the coldfinger's support. In some systems, however, there is a significant amount of hardware other than the detector that must be cooled by the cryocooler and the stiffness and strength of the coldfinger are insufficient to support that hardware. Moreover, there are other times where structural and vibrational isolation from the coldfinger are desired to reduce the impact of vibrations and movement from the coldfinger on the cryogenically cooled components. When the structure of the coldfinger is insufficient to support the cryogenic components, for any reason, an insulating structure must be devised that reliably holds the cryogenically cooled components while minimizing the additional parasitic heat load it adds to the cryocooler because of the additional thermal paths to warm components introduced by the supporting structure.

For example, some imaging sensor platforms with cryogenic Dewars include optical systems inside the Dewar that are cryogenically cooled. These systems can be quite large in relation to the coldfinger and must be supported in a way that adds as little thermal load as possible, doesn't overly stress the coldfinger, maintains alignment, and isolates the components from the vibrations of the cryocooler.

BRIEF SUMMARY

The tensioned intra-Dewar spider assembly of the present teachings can support a large system inside the Dewar in a way that adds as little thermal load as possible, doesn't overly stress the coldfinger, maintains alignment, and isolates the components from the vibrations of the cryocooler.

For a better understanding of the present teachings, together with other and further needs thereof, reference is made to the accompanying drawings and detailed description.

BRIEF DESCRIPTION OF THE DRAWINGS

FIG. 1 shows a cross-sectional view of an embodiment of the present teachings supporting electronic, optical, and mechanical components in a Dewar; and FIG. 2 shows three views of an embodiment of the present teachings.

FIG. 3 shows detail of the attachment in one embodiment of the invention.

DETAILED DESCRIPTION

The following detailed description presents the currently contemplated modes of carrying out the present teachings. The description is not to be taken in a limiting sense, but is made merely for the purpose of illustrating the general principles of the teachings.

The objects set forth above as well as further and other objects of the present teachings are achieved by the embodiments of the teachings described hereinbelow.

For a better understanding of the present teachings, together with other and further objects thereof, reference is made to FIG. 1, which shows an embodiment of a pair of tensioned intra-Dewar spider assemblies 120 and 130 supporting cryogenically cooled components 110 within a Dewar 140. The Dewar 140 has been cross-sectioned while the cryogenically cooled components 110 are shown in blue and the spider assemblies 120 and 130 supporting those components are shown in red. In this embodiment inside a cryogenic Dewar system 100, the cryogenically cooled components 110 are a detector and optics for an infrared imaging system.

Equation 1 details the thermal load constraint on a spider. The conductive load introduced by a spider is modeled as the integral of the conductivity of the material, k(T), over the temperature range times the ratio of the cross-sectional area, A, to the path length at the area, L. Reducing the value of the integral through material choice reduces load and reducing the value of the A/L ratio through geometry choices reduces load. In the embodiment depicted in FIG. 1, the cryogenically cooled components 110 inside the vacuum Dewar 140 are supported by two tensioned spider assemblies 120 and 130.

Reference is made to FIG. 2 for details of the tensioned spider assemblies 120 and 130. The tensioned spider assembly 200 is comprised of thin titanium alloy members 230 that are strong in tension. The following terms are used to describe these members 230 and should be considered interchangeable: thermal links, links, tensioned members, thin members, rods, tubes, and members. The members 230 are thin to reduce the cross-sectional area and long to increase the path length for thermal conduction, while the titanium alloy chosen has a high tensile strength and low average thermal conductivity, making it ideal for the application. The thin members 230 bridge the gap between a warm ring 220 and a cold ring 210 and are arranged and oriented to provide rigidity from their shape in addition to tensioning. The tensioned spider assemblies 120 and 130 in the embodiment in the cryogenic Dewar system 100 can be different in size and shape or the same, but they share the approach outlined in the tensioned spider assembly 200 shown in FIG. 2.

$$\dot{Q} = \frac{A}{L}\int_{T_L}^{T_H} k(T)dT$$

Equation 1: Conductive Load Calculation

Making the members 230 long and thin alone does not create a good support structure—long and thin components are rigid in tension but are not rigid in transverse or compressive directions due to bending and buckling, respectively. The embodiment of the tensioned spider assembly 200 of the present teachings detailed in FIG. 2 solves this problem by arranging the long, thin members 230 in a rotationally symmetric configuration. Loading in any direction except substantially in the negative z direction creates tension in some of the members 230. Since the members 230 are stiff in tension, the spider assembly 200 is stiff in those directions. By pairing two of the spider assemblies 120 and 130 together such that their local −z directions face opposite directions globally, the supported components 110 as shown in FIG. 1 are supported rigidly in all directions with low thermal loads. If the two spider assemblies 120 and 130 are preloaded on assembly or due to system operation, the stiffness will further increase due to the restoring force of the tension in the members 230 without adding more thermal load as would happen by increasing the stiffness by making thicker thermal links 230. Properly preloading the spiders 120 and 130 in tension will also prevent loss of tension due to operational thermal changes. As an added benefit, having spiders 120 and 130 in tension increases the stiffness while maintaining a low mass structure, which can be important for improved dynamic stiffness and resistance to vibration and for reduced weight in weight-sensitive applications.

In one embodiment of the disclosed teaching, the spider structures are metal structures. Reference is made to FIG. 3, a detailed view 300 of the method of attachment of the thermal links 230 to the outer ring 220. The attachment to the inner ring 210 can be performed in the same manner. The thermal links 230, titanium in one instance, are attached with screws 310 and welding in one instance, although attachment with soldering, brazing, pinning, riveting or other methods is possible. Other embodiments to cryogenically support components tend to use glasses or plastics to provide thermal insulation and support. Glasses are susceptible to brittle failure and are, therefore, difficult to attach to other components via conventional methods. Plastics are easier to work with, but are susceptible to creep over time, causing the loss of alignment of the cryogenic components to components on the outside of the Dewar. Additionally, plastics tend to outgas water and volatile compounds, adding to the total gas load inside the Dewar—a negative impact for a long-lifetime vacuum Dewar.

A rotationally symmetric embodiment of the disclosed teachings, such as the all metal embodiment disclosed above, has some desirable properties. Because it is rotationally symmetric, if the ring 220 that attaches to the Dewar assembly 140 or other warm structures is made from the same material as the Dewar 140 or those warm structures and the ring 210 that attaches to the cold components 110 is made from the same material as the cold components 110 (as it is in this embodiment 100), then the stress from cooling to cryogenic temperatures and from ambient temperature changes of the Dewar is concentrated in the links 230 and not in the mounting rings 220 and 210. The symmetry of the orientation of the links 230 within the assembly 200 means that that stress in them does not convert into movement of the assembly upon applying preload to the assembly the z-direction by separating the inner ring 210 and the outer ring 220 by some small amount. In other words, the assembly maintains orientation and position over temperature variation and tensioning. This is especially important for optical systems that must be aligned to components outside of the Dewar.

Other embodiments of the disclosed invention have other structures instead of the inner ring 210 and outer ring 220, such as independent mounts, blocks, brackets, or other structures, but the links 230 and symmetric arrangement shown in the present embodiment 200 are necessary for the alignment stability and symmetric stiffness of the structure. In other embodiments of the invention the rings are not circular but can be other shapes including, without limitation, squares, polygons, irregular shapes, etc.

In another embodiment of the disclosed invention not depicted, the tensioned spider assembly 200 can be used individually. If, for example, the z-axis is aligned with the axis of a cold finger 150, then the spider members can provide rigidity and a tension can be maintained in them by preloading against the coldfinger. The load path in this case would pass from the Dewar 140, through the spider outer ring 220, through the links 230 in tension, through the inner ring 210, through the cold components 110, through the cold finger 150, and thus back to the Dewar 140. With a sufficiently stiff cold finger, the z-axis would not need to be aligned with the cold finger axis, but the direction of the preload would need to be in the negative z direction within the local reference frame of the spider 200. This caveat is because the cold finger 150 is much more rigid in tension than in bending and small curvatures of the cold finger can be detrimental to its operation in the context of a cryocooler.

Other embodiments of the present teachings include, but are not limited to, the use of tubes, rods, wires, glass fibers, plastic filaments, plastic links, ceramics, or other substantially insulating structures and materials.

Although these teachings have been described with respect to various embodiments, it should be realized these teachings are also capable of a wide variety of further and other embodiments within the spirit and scope of these teachings.

What is claimed is:

1. A thermally isolating mounting device comprising:

a first structure;

a second structure;

said second structure comprising cryogenically cooled components;

a mounting structure;

said second structure being mounted with respect to said first structure;

said mounting structure further comprising a first substructure and a second substructure;

said first substructure mounting to said first structure;

said second substructure mounting to said second structure;

said first substructure and said second substructure at different temperatures;

said first substructure attached to said second substructure by at least two members;

said members connecting said first substructure to said second substructure;

said members further providing rigidity;

said rigidity further enhanced by tensioning;

a cold finger;

said second structure being thermally operatively connected to said cold finger.

2. The thermally isolating mounting device of claim 1 wherein the said members are hollow.

3. The thermally isolating mounting device of claim 1 wherein the said members are metallic.

4. The thermally isolating mounting device of claim 1 wherein the said members comprise a composite material.

5. The thermally isolating mounting device of claim 1 wherein the said members are tensioned.

6. The thermally isolating mounting device of claim 1 wherein the said cryogenically cooled components comprise at least one of electronic, optical, or mechanical components.

7. The thermally isolating mounting device of claim 1 wherein the said first structure comprises a Dewar.

8. A thermally isolating mounting device comprising:

a first structure;

a second structure;

said second structure comprising cryogenically cooled components;

at least two thermally isolating structures;

said at least two thermally isolating structures being attached to said first structure and said second structure;

each one of the at least two thermally isolating structures mounting said second structure to said first structure;

said each one of the at least two thermally isolating structures comprising two rings;

said two rings being at different temperatures;

one of said two rings attached to another of said two ring by at least two links;

said links further providing rigidity in said each one of the at least two thermally isolating structures;

said rigidity in said each one of the at least two thermally isolating structures further enhanced by tension;

and, said thermally isolating structures substantially thermally isolating said second structure from said first structure;

a cold finger;

said second structure being thermally operatively connected to said cold finger.

9. The thermally isolating mounting device of claim 8 wherein said at least two thermally isolating structures are an opposing pair of structures, each one of said opposing pair of structures supplying preload for an opposing structure.

10. The thermally isolating mounting device from claim 8 where said first structure is connected to warmer components.

11. The thermally isolating mounting device from claim 10 where the cryogenically cooled components are cryogenic optics and said warmer components are components of a cryogenic Dewar.

12. The thermally isolating mounting device from claim 8 wherein said thermally isolating structures are arranged symmetrically about an axis.

13. The thermally isolating mounting device of claim 8 wherein the said cryogenically cooled components comprise at least one of electronic, optical, or mechanical components.

14. The thermally isolating mounting device of claim 8 wherein the said first structure comprises a Dewar.

15. The thermally isolating mounting device of claim 8 wherein at least one of said two rings comprises one of a square, a polygon or irregular shape.

16. The thermally isolating mounting device of claim 8 wherein at least one of said two rings comprises one of an independent mount, a block, or a bracket.

* * * * *